United States Patent [19]

Yamada et al.

[11] Patent Number: 4,560,471

[45] Date of Patent: Dec. 24, 1985

[54] POWDER CLASSIFIER

[75] Inventors: Yukiyoshi Yamada, Tokorozawa; Masayuki Yasuguchi, Sagamihara, both of Japan

[73] Assignees: Nisshin Flour Milling Co. Ltd.; Nisshin Engineering Co., Ltd., both of Tokyo, Japan

[21] Appl. No.: 497,235

[22] Filed: May 23, 1983

[30] Foreign Application Priority Data

Jun. 30, 1982 [JP] Japan ..... 57-113337

[51] Int. Cl.[4] ..... B07B 7/083

[52] U.S. Cl. ..... 209/144; 209/145; 209/148

[58] Field of Search ..... 209/144–148, 209/150; 55/402, 403, 40

[56] References Cited

U.S. PATENT DOCUMENTS

| | | | |
|---|---|---|---|
| 1,232,464 | 7/1917 | Houghton | 55/407 |
| 2,338,779 | 1/1941 | Mutch | 209/145 |
| 2,542,095 | 2/1951 | Rouget | 209/145 |
| 2,796,173 | 6/1957 | Payne et al. | 209/144 |
| 2,943,734 | 7/1960 | Payne et al. | 209/144 |
| 2,943,735 | 7/1960 | Payne et al. | 209/144 |
| 3,048,271 | 8/1962 | Sharples | 209/144 |
| 3,234,716 | 2/1966 | Sevin et al. | 55/408 |
| 3,498,453 | 3/1970 | Kaiser et al. | 209/144 |
| 4,236,997 | 12/1980 | Wessel et al. | 209/145 |

FOREIGN PATENT DOCUMENTS

| | | | |
|---|---|---|---|
| 834319 | 3/1952 | Fed. Rep. of Germany | 209/144 |
| 11269 | 3/1982 | Japan . | |
| 694219 | 7/1953 | United Kingdom | 209/144 |
| 971868 | 10/1964 | United Kingdom | 209/144 |

*Primary Examiner*—Frank W. Lutter
*Assistant Examiner*—Wm. Bond
*Attorney, Agent, or Firm*—Oblon, Fisher, Spivak, McClelland & Maier

[57] ABSTRACT

A powder classifier having two stages of classification blades which are arranged to intersect the radial directions of the powder classifier.

1 Claim, 3 Drawing Figures

POWDER CLASSIFIER

BACKGROUND OF THE INVENTION (i) Field of the Invention

This invention relates to powder classifiers, and an object of this invention is to provide a powder classifier which has excellent accuracy of powder classification and mechanical endurance.

(ii) Description of the Prior Art

In general, classification blades in a powder classifier are arranged at equal intervals in such directions as to coincide with radial directions. In order to make a cut size small by the use of a classifier of the just-mentioned type, the speed of rotation has to be high. However, higher speed of rotation results in a more inclined distribution of air velocity toward radial directions, with the attendant drawback that accuracy of classification worsens. In addition, high speed of rotation will impede mechanical endurance.

SUMMARY OF THE INVENTION

We have made extensive studies in order to overcome the prior art drawbacks and found that when classification blades are arranged at intersecting directions of radius, a cut size can be set smaller even at a low speed of rotation than in the case of the prior art.

According to the present invention, there is provided a powder classifier comprising a casing having a powder charge port at an upper central portion thereof and having an air intake port which is provided along a periphery of an outer side wall of the casing; a classification rotor having a hollow portion which enables air to pass from a circumferential portion toward an axis thereof, and said rotor being provided within the casing rotatably about a vertical rotary shaft; a multitude of classification blades which are provided in two stages as intersecting directions of radius within a circumferential portion of a classification chamber in the hollow portion of said classification rotor; and a powder charge opening established between the two groups of the classification blades.

1 . . . casing, 2*a* . . . powder charge port, 2*b* . . . air charge port, 3 . . . hollow portion, 4 . . . classification rotor, 6 . . . rotary shaft, 7,8 . . . classification blades, 10 . . . powder charge ring opening, 11 . . . classification chamber, 12 . . . auxiliary blades, 13 . . . space, 14 . . . coarse powder discharge port, 16 . . . primary dispersion blades, 17 . . . secondary dispersion space, 18 . . . balance rotor, 21 . . . scroll casing, 19 . . . hollow portion

DETAILED DESCRIPTION OF THE INVENTION AND PREFERRED EMBODIMENTS

One embodiment of the present invention is described with reference to the accompanying drawings.

Figure 2:
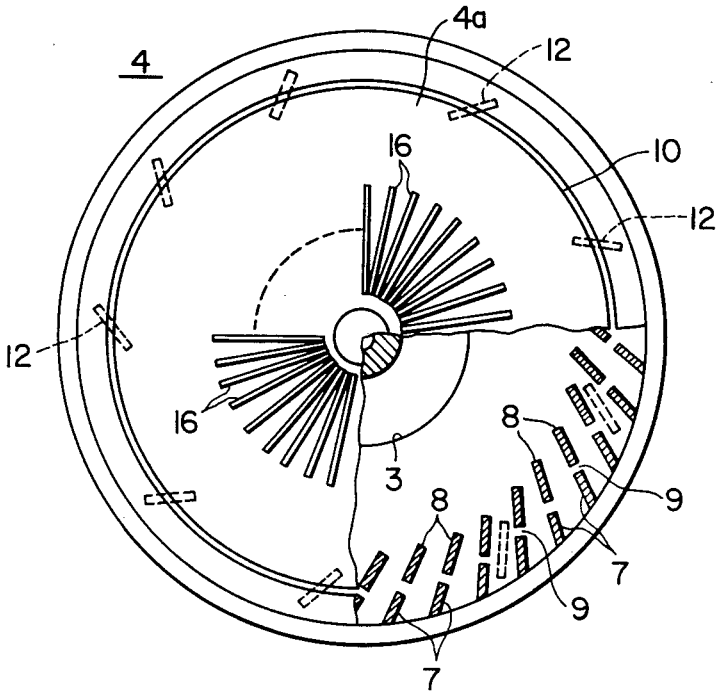
FIG. 2 is a plan view, partly cut away, of a classification rotor according to the invention.
Figure 3:
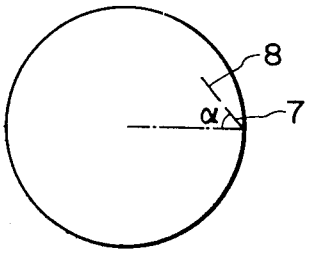
FIG. 3 is an illustrative view showing an intersection angle with a direction of radius of a classification blade.

In the drawings, indicated at 1 is a casing which includes a powder charge port 2*a* connected at an upper central portion thereof with a powder feeder (not shown) and an air intake port 2*b* which is provided along a peripheral side portion of the casing. Within the casing 1 is provided a disc-shaped classification rotor 4 having a hollow portion 3 communicating from a circumferential portion to an axis thereof. The classification rotor 4 is fixedly secured integrally to an upper end of a rotary shaft 6 which is vertically supported by bearings 5, 5 along the axis of the casing 1. Along the outer circumferential opening portion of the hollow portion 3 of the classification rotor 4 are disposed a multitude of outside classification blades 7 arranged at intersecting directions of radius at certain angles as shown in FIG. 2. At the inner side of the outside classification blades 7 are also provided a multitude of inside classification blades 8 which are in face-to-face relation with the outside classification blades 7 and are arranged at intersecting directions of radius. The outside and inside clasification blades 7, 8 are arranged in two stages and form gaps 9 thereinbetween. At an upper plate 4*a* of the classification rotor 4 which is in face-to-face relation with the gaps 9 is formed a powder charge opening 10 of a ring form which communicates with the hollow portion 3. By this classification blade construction, there is established a classification chamber 11 (7 and 8) of wide forced vortex which includes portions of the outside and inside classification blades 7 and 8 corresponding to coarse and fine powder sides, respectively.

At the opposite site of the classification blades 7, 8 being located, on the under surface of the classification rotor 4, are provided a multitude of auxiliary blades 12 which are provided at intersecting radial directions and are arranged at equal intervals. When the classification rotor 4 is turned, the air is flown in the direction of rotation of the auxiliary blades 12 by the action therof, so that it is whirled into the classification chamber 11. Indicated at 13 is a space formed around the outer periphery of the classification rotor 4. A coarse powder discharge port 14 communicating with the space portion 13 is formed in the casing 1.

An angle, $\alpha$, of intersection with radial directions of the classification blades 7, 8 and the auxiliary blades 12 is in the range of 20° to 70° and optimumly about 5°.

In this connection, when an intersection angle, $\alpha$, is smaller than 20°, an appreciable effect of the intersection cannot be expected. On the other hand, when it exceeds 70°, dispersability of fed powder deteriorates. Moreover, when the auxiliary blades 12 are provided in alignment with radial directions, it is unfavorable because the air flow abruptly changes at certain angles. Accordingly, it is convenient to set the auxiliary blades 12 at an angle substantially the same as an intersection angle, $\alpha$ of the classification blades 7, 8.

Indicated at 15 is a space established between the upper plate 4*a* of the classification rotor 4 and a top plate of the casing 1, permitting communication between the powder charge port 2*a* and the powder charge opening 10 of the ring form. From the central portion of the upper plate 4*a* of the classification rotor 4 in the space 15 are provided a multitude of powder dispersion blades 16 radially and outwardly extending from the core portion. The upper plates 4*a* of the classification rotor 4 extending between the end portions of the dispersion blades 16 and the powder charge ring opening 10 is made flat. Between this flat surface and the inner surface of the casing 1 is formed a dispersion space 17 in which powder is secondarily dispersed.

Indicated at 18 is a balance rotor in a disc shape which has a hollow portion 19 communicating from the circumferential portion to the core portion similar to the classification rotor 4. This balance rotor 18 is integrally fixed to the rotary shaft 6 within the casing 1 so that it is positioned symmetrically with the classification rotor 4 and the hollow portion 19 communicates with the hollow portion 3. The balance rotor 18 has a multitude of blades 20 at a peripheral opening portion of the hollow portion 19. At an outer circumferential opening of the balance rotor 18 is surrounded by a vortex casing 21 which is integrally and air-tightly attached to the casing 1. The vortex casing 21 is connected with a collecting apparatus such as a cyclone, bag filter or the like which are not shown.

The operation of the classifier according to the invention is described hereinafter.

Figure 1:
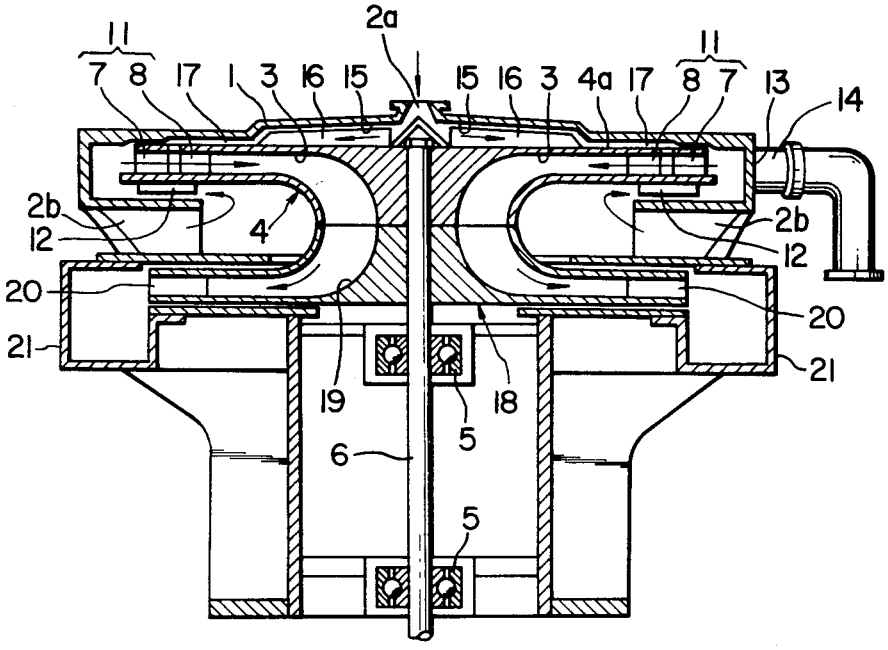
FIG. 1 is a longitudinal sectional view of one embodiment of a powder classifier according to the invention.

First, the classification rotor 4 and the balance rotor 18 are rotated at a desired speed by means of a motor not shown. As a result, an air flow of negative pressure is produced within the classifier by the action of suction of the balance rotor 18 and by a blower connected with outside. The air flow introduced from the air intake port **2*b* of the casing 1 is converted into a flow in the direction of rotation by means of the auxiliary blades 12. The air is then passed from the space 13 into the classification chamber 11 in which it is converted into a stream having the same peripheral speed as the classification rotor 4 by means of the classification blades 7,8. At the same time, because the air is sucked by the balance rotor and blower, it becomes to have an air velocity in a radial direction at the circumference of the classification chamber 11. The air passed through the balance rotor 18 is fed through the vortex casing 21 into a blower of the cyclone. The air flow in the foregoing construction is indicated by arrows of FIG. 1**.

In this state, starting powder charged from the powder charge port **2*a* is entrained with the air stream and passed through the dispersion blades 16. During the passage, the powder is substantially dispersed in radial directions about the axis core of the classification rotor 4, ensuring primary dispersion of the powder. The powder discharged from the ends of the dispersion blades 16 is radiated in substantially tangential directions of the circle of the dispersion blade arrangement accompanied by rotation of the classification rotor 4, resulting in secondary dispersion in the dispersion space 17. The powder which has fully been dispersed in a manner described above is fed through the powder charge ring opening 10 into the classification chamber 11 in which individual particles of the powder receive a centrifugal force ($\pi Dp^3/6 \times \delta P \times Vo^2/R$) caused by the rotary stream and a drag force ($3\alpha\mu VrDp$) derived from the flow in radial directions. Among the particles, those coarse particles which ensures establishment of the relation of centrifugal force>drag force are blown away into the space 13 located at the outer circumference of the classification rotor 4 and are discharged from the coarse powder discharge port 14 to outside of the classifier by the use of, for example, a rotary valve in an air-sealed state. On the other hand, fine particles establishing the relation of centrifugal force<drag force are pneumatically carried through the balance rotor 18 and scroll casing 21** to outside of the classifier while entraining with the air stream of radial directions. The fine particles are collected by a collector such as a cyclone, bag filter or the like.

In the above formulas,

Dp: average size of particles $\delta p$: density of particles

Vo: air velocity along circumference

Vr: air velocity in radial directions

R: radius of cut zone $\mu$: viscosity coefficient of air

Control of the cut size in the classifier of the arrangement described before is effected by changing the speed of rotation of the classification rotor 4 and the amount of air passing through the classification chamber 11.

The results of classification of wheat flour using the classifier (60 =45°) of the present invention are shown in Tables below in comparison with a known classifier in which classification blades are formed radially in conformity with radial directions.

TABLE 1

| | Cut Size | Speed of Rotation |
|---|---|---|
| Invention | 6.5 μm | 2,000 r.p.m. |
| Prior Art | 10 μm | 2,000 r.p.m. |

TABLE 2

| | Cut Size | Speed of Rotation |
|---|---|---|
| Invention | 5 μm | 6,700 r.p.m. |
| Prior Art | 5 μm | 8,717 r.p.m. |

TABLE 3

| | Cut Size | Speed of Rotation |
|---|---|---|
| Invention | 3 μm | 18,330 r.p.m. |
| Prior Art | 3 μm | 23,700 r.p.m. |

As will be apparent from the above tables, according to the classifier of the invention, there can be obtained small cut sizes at low speed of rotation, so that the adverse influence of high speed rotation as in prior art can be avoided. As a result, the accuracy of classification and mechanical endurance can be improved with a reduced consumption of energy.

What is claimed as new and desired to be secured by Letters Patent of the United States is:

1. A powder classifier comprising:

(a) a casing containing at an upper center thereof a powder charge port and, at the periphery of outer side walls thereof, air intake ports;

(b) a rotary shaft vertically supported by bearings along the axis of said casing;

(c) a classification rotor having a hollow interior within said casing, secured to the upper end of said rotary shaft;

(d) a series of classification blades within the outer circumferential opening of said hollow interior of said classification rotor wherein said series of classification blades consists of a multitude of outside classification blades distinctly separated from a multitude of inside classification blades wherein said outside and inside classification blades are in face-to-face relation with each other and further wherein said series of classification blades intersect the radial directions of said classifier in an angle of between 20° and 70°;

(e) a powder charge opening on the upper plate of said classification rotor in face-to-face relation with the space existing between said outer and inner classification blades; and (f) a series of auxiliary blades on the undersurface of said classification rotor; wherein the angle of intersection with radial directions of said series of said auxiliary blades is between 20° and 70°.

* * * * *